US008079354B2

(12) United States Patent
Chen

(10) Patent No.: US 8,079,354 B2
(45) Date of Patent: Dec. 20, 2011

(54) PAINTBALL SENSOR INSTALLING AND POSITIONING STRUCTURE

(75) Inventor: Yi-Tsong Chen, Tainan (TW)

(73) Assignee: Hsin-Cheng Yeh, Tainan (TW)

( * ) Notice: Subject to any disclaimer, the term of this patent is extended or adjusted under 35 U.S.C. 154(b) by 71 days.

(21) Appl. No.: 12/785,731

(22) Filed: May 24, 2010

(65) Prior Publication Data

US 2011/0265776 A1 Nov. 3, 2011

(30) Foreign Application Priority Data

Apr. 29, 2010 (TW) ..... 99207818 U

(51) Int. Cl.
*F41B 11/06* (2006.01)

(52) U.S. Cl. ..... 124/32; 124/73
(58) Field of Classification Search ..... 124/32, 124/73
See application file for complete search history.

(56) References Cited

U.S. PATENT DOCUMENTS

| | | | | |
|---|---|---|---|---|
| 5,727,538 | A * | 3/1998 | Ellis | 124/77 |
| 6,966,313 | B1 * | 11/2005 | Yokota et al. | 124/32 |
| 7,461,646 | B2 * | 12/2008 | Jones | 124/77 |
| 7,640,923 | B1 * | 1/2010 | Chen | 124/32 |
| 2003/0221684 | A1 * | 12/2003 | Rice | 124/71 |
| 2006/0107938 | A1 * | 5/2006 | Rice | 124/73 |
| 2007/0209650 | A1 * | 9/2007 | Jones | 124/73 |
| 2008/0078370 | A1 * | 4/2008 | Kaakkola et al. | 124/73 |

* cited by examiner

*Primary Examiner* — Troy Chambers
(74) *Attorney, Agent, or Firm* — WPAT., P.C.; Justin King

(57) ABSTRACT

A paintball sensor installing and positioning structure includes a sensor unit screwed to the bottom end of a paintball dropping conduit. A transmitting end and a receiving end of the sensor unit are received respectively in receiving grooves bilaterally provided on the paintball dropping conduit. Positioning elements protruding from the bottom end of the paintball dropping conduit correspond in position to positioning recesses in a gun body to provide secure positioning. A pin at a lower portion of the sensor unit is inserted in a socket of the gun body. Gas inlet ducts provided in the inner wall of the gun body are separate from a paintball dropping port of the paintball dropping conduit such that gas need not pass through the paintball dropping conduit. Hence, corresponding gas ducts can be connected regardless of the precision with which the paintball dropping conduit is installed in the gun body.

6 Claims, 5 Drawing Sheets

PAINTBALL SENSOR INSTALLING AND POSITIONING STRUCTURE

BACKGROUND OF THE INVENTION

1. Field of the Invention

The present invention relates to a paintball sensor installing and positioning structure and, more particularly, to a structure including a paintball dropping conduit which is securely positioned when installed in a gun body and through which gas need not pass, thus allowing corresponding gas ducts to be connected regardless of the precision with which the paintball dropping conduit is installed in the gun body.

2. Description of the Related Art

Paintball guns are the essential equipment for playing paintball, which is a popular recreational activity worldwide that takes the form of survival games. In order to prevent blockage of unfired paintballs and consequently empty shots, which are a waste of the high-pressure gas used for propelling paintballs, a paintball gun is typically provided with a sensor and a paintball stopping device where paintballs are dropped in the gun body. For example, Taiwan Patent No. M356104, which was granted to the inventor of the present invention, discloses a "Hidden Paintball Sensor Installing Structure" as shown in FIG. 5, wherein the structure includes a sensor A, a paintball dropping conduit B, and a gun body C configured to receive the paintball dropping conduit B inserted therein. The sensor A has a transmitting end A1 and a receiving end A2 that correspond in position to each other. The sensor A further includes a mounting seat A3 provided at a lower portion thereof and centrally formed with an insertion hole A4. The paintball dropping conduit B has a bottom end externally and bilaterally provided with receiving grooves B1 into which the transmitting end A1 and the receiving end A2 of the sensor A are inserted respectively from below. The mounting seat A3 of the sensor A is pivotally mounted around a fixing element B2 protrudingly provided at the bottom end of the paintball dropping conduit B. Arcuate slots B3 are formed on the outer periphery of the paintball dropping conduit B above the receiving grooves B1. Each arcuate slot B3 has a through portion penetrating the wall of the paintball dropping conduit B and is fitted with a resilient stopper B4. Gas ducts B5 are penetratingly provided at a lower portion of the paintball dropping conduit B. The gun body C has a top end formed with a paintball dropping port C1 for receiving the paintball dropping conduit B inserted therein. Recesses C2 are provided on the inner wall of the gun body C and correspond in position to the stoppers B4 of the paintball dropping conduit B so that the stoppers B4 can be pressed outward.

However, the aforesaid structure has the following drawbacks in installation:

1. As the gas ducts are provided at the lower portion of the paintball dropping conduit, lack of precision in installing the paintball dropping conduit will increase the difficulty in connecting corresponding gas ducts and hence reduce the tightness therebetween.

2. The corresponding transmitting and receiving ends of the sensor must be inserted in a sliding manner from below the bottom end of the gun body into the receiving grooves externally and bilaterally provided at the bottom end of the paintball dropping conduit; however, the inserting operation is difficult to perform in such a limited space. Besides, the fixing element protrudingly provided at the bottom end of the paintball dropping conduit cannot be secured in place unless it is pivotally mounted with the mounting seat of the sensor first. Therefore, assembly of the various components of the structure is laborious and time consuming.

BRIEF SUMMARY OF THE INVENTION

In view of the above, the present invention provides a paintball sensor installing and positioning structure capable of solving the aforesaid problems of the prior art, which include the difficulty in connecting corresponding gas ducts if the paintball dropping conduit is installed in the gun body with insufficient precision, and the laborious and time-consuming process of assembling a large number of components.

According to the present invention, a paintball sensor installing and positioning structure includes a sensor unit, a paintball dropping conduit, and a gun body. The sensor unit has a transmitting end and a receiving end which are bilaterally provided on the sensor unit and correspond in position to each other. The sensor unit further includes a pin at a lower portion thereof. The paintball dropping conduit has a top end centrally formed with a paintball dropping port and a bottom end to which the sensor unit is screwed. The outer periphery of the paintball dropping conduit has a bottom end bilaterally provided with receiving grooves for receiving the transmitting end and the receiving end of the sensor unit, respectively. The receiving grooves are further provided with through holes to allow signal transmission between the transmitting end and the receiving end. Besides, the bottom end of the paintball dropping conduit is protrudingly provided with a positioning element. The gun body has a top end formed with a receiving hole for receiving the paintball dropping conduit inserted therein. The gun body is concavely provided with a positioning recess corresponding in position to the positioning element of the paintball dropping conduit. A gas inlet duct is provided in the inner wall of the gun body and is separate from the paintball dropping port. A socket is screwed to a bottom end of the gun body, in communication with the paintball dropping port, and configured for connection with the pin of the sensor unit.

Preferably, arcuate slots are provided on the outer periphery of the paintball dropping conduit above the receiving grooves.

Preferably, each of the arcuate slots is fitted with a resilient stopper.

Preferably, each of the stoppers has an end whose inner surface is provided with a stud extending into the paintball dropping port of the paintball dropping conduit.

Preferably, the top end of the paintball dropping conduit includes a flange penetrated by a first threaded hole.

Preferably, a second threaded hole is provided beside the receiving hole of the gun body.

The present invention provides the following advantages:

1. With the fixing element protrudingly provided at the bottom end of the paintball dropping conduit and corresponding in position to the positioning recess of the gun body, the paintball dropping conduit is securely positioned when installed in the gun body.

2. When the paintball dropping conduit is installed in the gun body, the pin of the sensor unit screwed to the bottom end of the paintball dropping conduit corresponds in position to and is therefore easily inserted in the socket at the bottom end of the gun body.

3. With the gas inlet duct provided in the inner wall of the gun body and being separate from the paintball dropping port, gas need not pass through the paintball dropping conduit, and in consequence the connection between corresponding gas ducts can be carried out regardless of the installation precision of the paintball dropping conduit.

BRIEF DESCRIPTION OF THE SEVERAL VIEWS OF THE DRAWINGS

A detailed description of further features and advantages of the present invention is given below with reference to the accompanying drawings, in which.

DETAILED DESCRIPTION OF THE INVENTION

Figure 1:
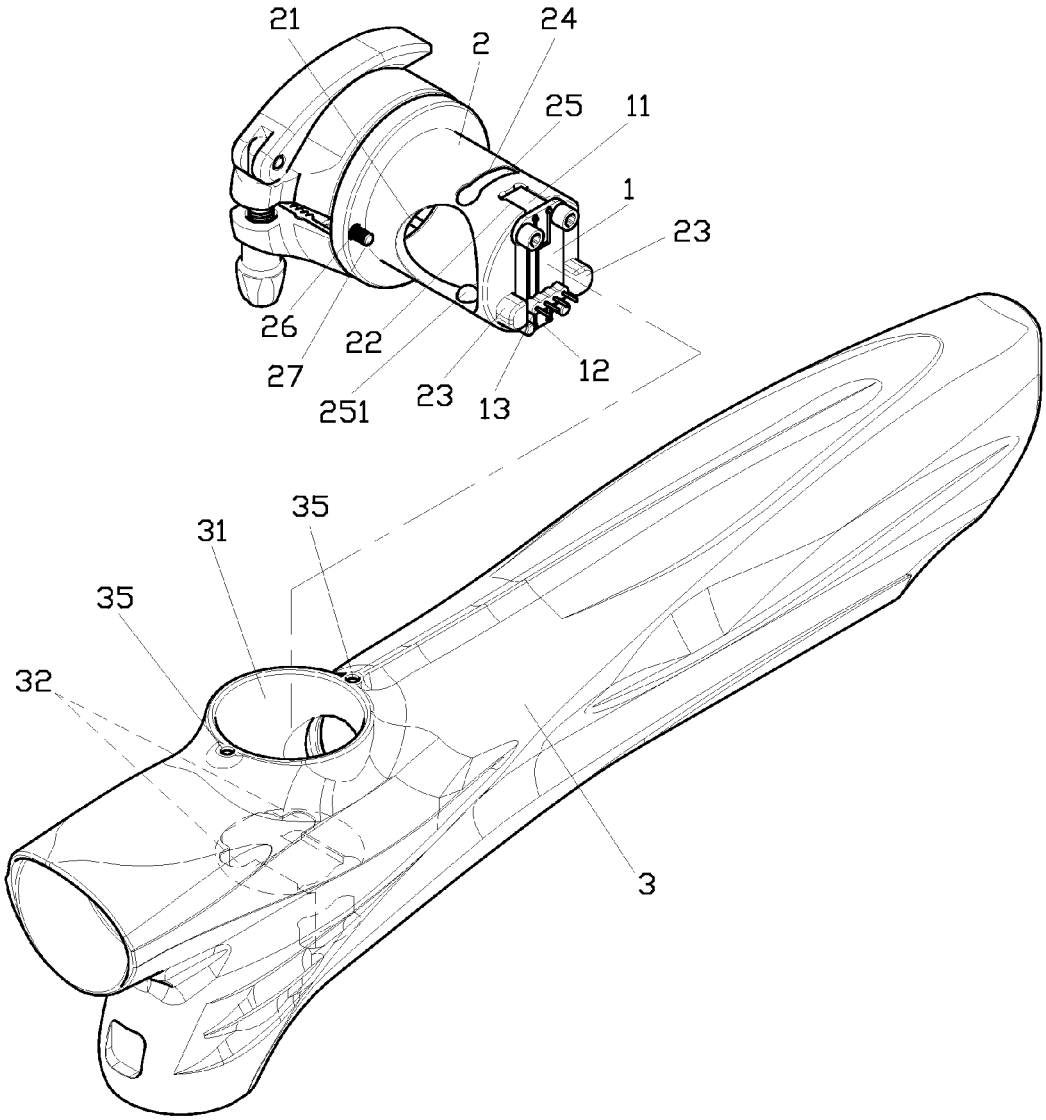
FIG. 1 is an exploded perspective view of the present invention.
Figure 2:
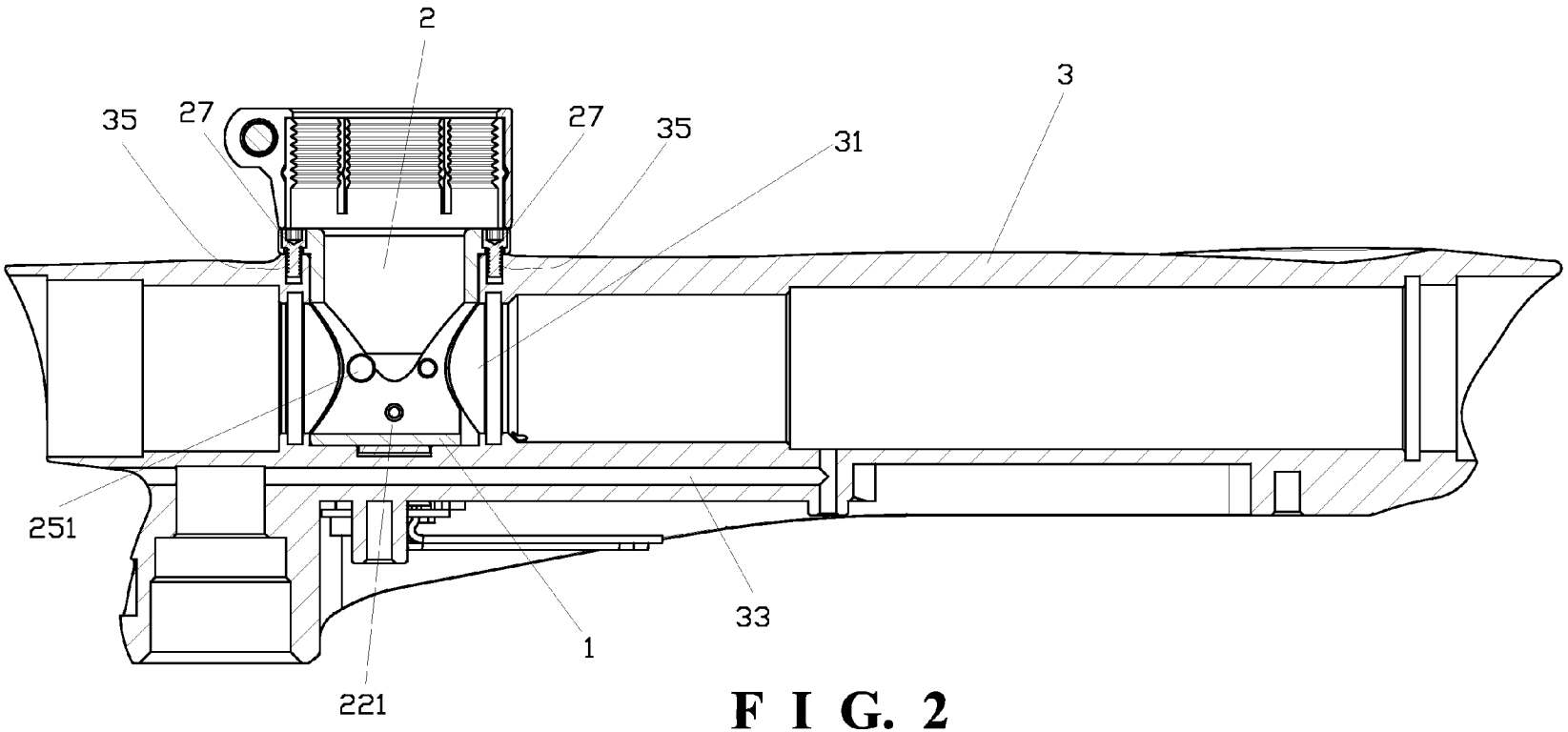
FIG. 2 is a sectional view of the present invention.

Referring to FIG. 1 and FIG. 2, a paintball sensor installing and positioning structure according to the present invention includes a sensor unit 1, a paintball dropping conduit 2, and a gun body 3.

The sensor unit 1 has a transmitting end 11 and a receiving end 12 which are bilaterally provided on the sensor unit 1 and correspond in position to each other. In addition, the sensor unit 1 includes a pin 13 at a lower portion thereof.

A paintball dropping port 21 is centrally provided at the top end of the paintball dropping conduit 2, and the sensor unit 1 is threadingly fixed to the bottom end of the paintball dropping conduit 2. The outer periphery of the paintball dropping conduit 2 has a bottom end bilaterally formed with receiving grooves 22 for receiving the transmitting end 11 and the receiving end 12 of the sensor unit 1, respectively. As shown in FIG. 2, each receiving groove 22 has a through hole 221 to enable signal transmission between the transmitting end 11 and the receiving end 12. Besides, positioning elements 23 are protrudingly and bilaterally provided at the bottom end of the paintball dropping conduit 2. Arcuate slots 24 are formed on the outer periphery of the paintball dropping conduit 2 above the receiving grooves 22, wherein each arcuate slot 24 has a through portion penetrating the wall of the paintball dropping conduit 2 and is fitted with a resilient stopper 25. A stud 251 is provided on the inner surface of one end of each stopper 25 and extends into the paintball dropping port 21 of the paintball dropping conduit 2 through the through portion of the corresponding arcuate slot 24. The top end of the paintball dropping conduit 2 includes a flange penetrated by first threaded holes 26. The first threaded holes 26 are respectively and threadingly fastened with first threaded fasteners 27.

Figure 3:
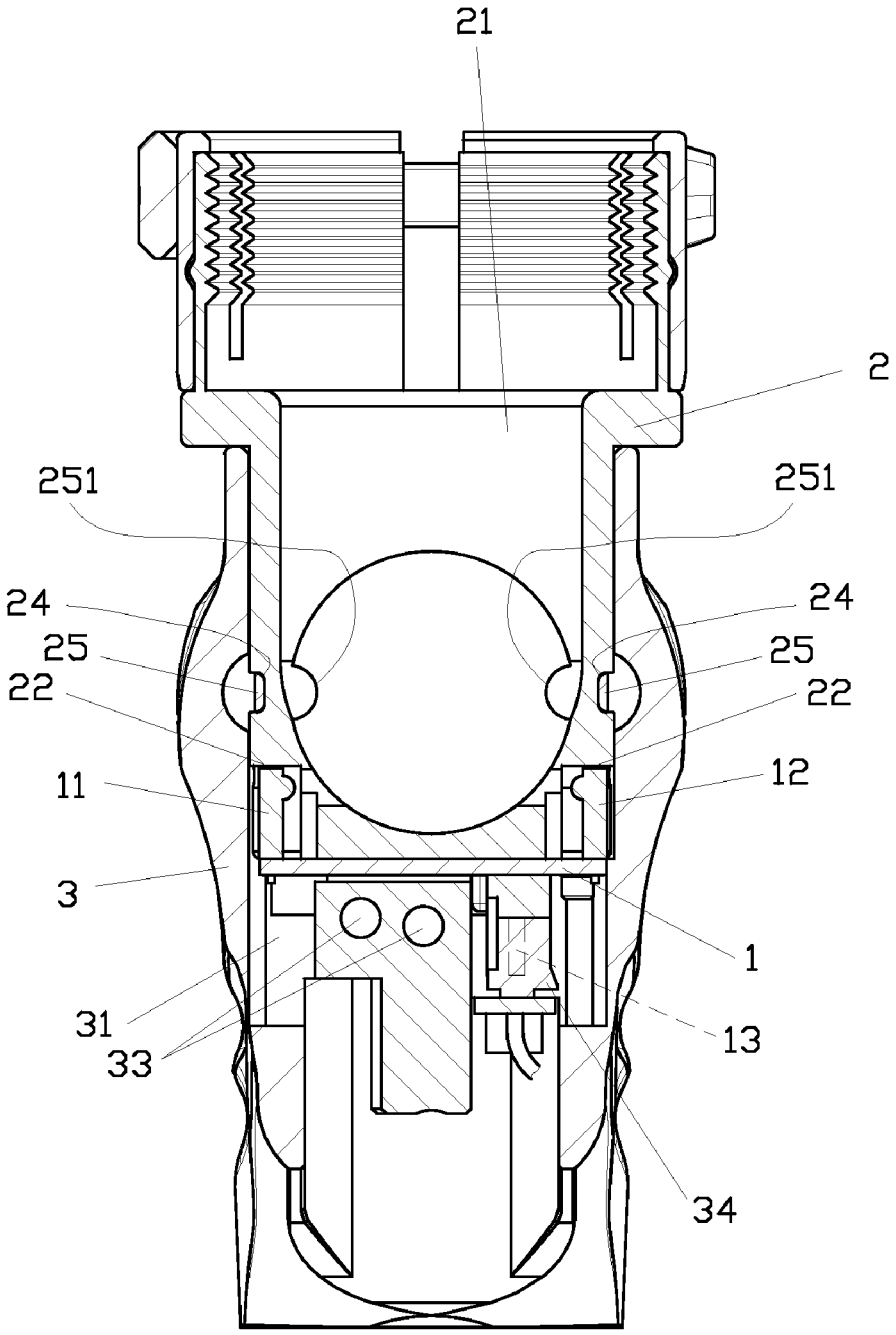
FIG. 3 is a longitudinal sectional view of a paintball dropping conduit according to the present invention.

A receiving hole 31 is formed at the top end of the gun body 3 and configured to receive the paintball dropping conduit 2 inserted therein. Positioning recesses 32 are concavely provided on the gun body 3 and correspond in position to the positioning elements 23 of the paintball dropping conduit 2. Gas inlet ducts 33 are provided in the inner wall of the gun body 3 and spaced apart from the paintball dropping port 21 of the paintball dropping conduit 2 such that gas need not pass through the paintball dropping conduit 2. Therefore, the connection of corresponding gas ducts will not be rendered difficult by lack of precision in installing the paintball dropping conduit 2 in the gun body 3. In addition, a socket 34 is threadingly fixed to the bottom end of the gun body 3 and communicates with the paintball dropping port 21. The socket 34 is configured for being inserted by and hence connected with the pin 13 of the sensor unit 1, as shown in FIG. 3. Besides, second threaded holes 35 are provided beside the receiving hole 31 of the gun body 3 and correspond in position to the threaded fasteners 27 that pass through the flange at the top end of the paintball dropping conduit 2.

Assembly of the aforesaid components is now described with reference to FIG. 2 and FIG. 3 in conjunction with FIG. 1. To begin with, the sensor unit 1 is screwed to the bottom end of the paintball dropping conduit 2 such that the corresponding transmitting and receiving ends 11, 12 bilaterally provided on the sensor unit 1 are received respectively in the receiving grooves 22 bilaterally provided at the bottom end of the outer periphery of the paintball dropping conduit 2. Then, the positioning elements 23 protrudingly provided on the bottom end of the paintball dropping conduit 2 are aligned and engaged with the positioning recesses 32 in the gun body 3, thereby rapidly positioning the paintball dropping conduit 2 in relation to the gun body 3. Meanwhile, the pin 13 at the lower portion of the sensor unit 1 is inserted into the socket 34 at the bottom end of the gun body 3. Afterward, the threaded fasteners 27 are passed sequentially through the first threaded holes 36 in the flange at the top end of the paintball dropping conduit 2 and the second threaded holes 35 beside the receiving hole 31 of the gun body 3 to screw the paintball dropping conduit 2 to the gun body 3. Thus, the sensor unit 1 and the paintball dropping conduit 2 are rapidly installed in the gun body 3 and securely positioned therein.

Figure 4:
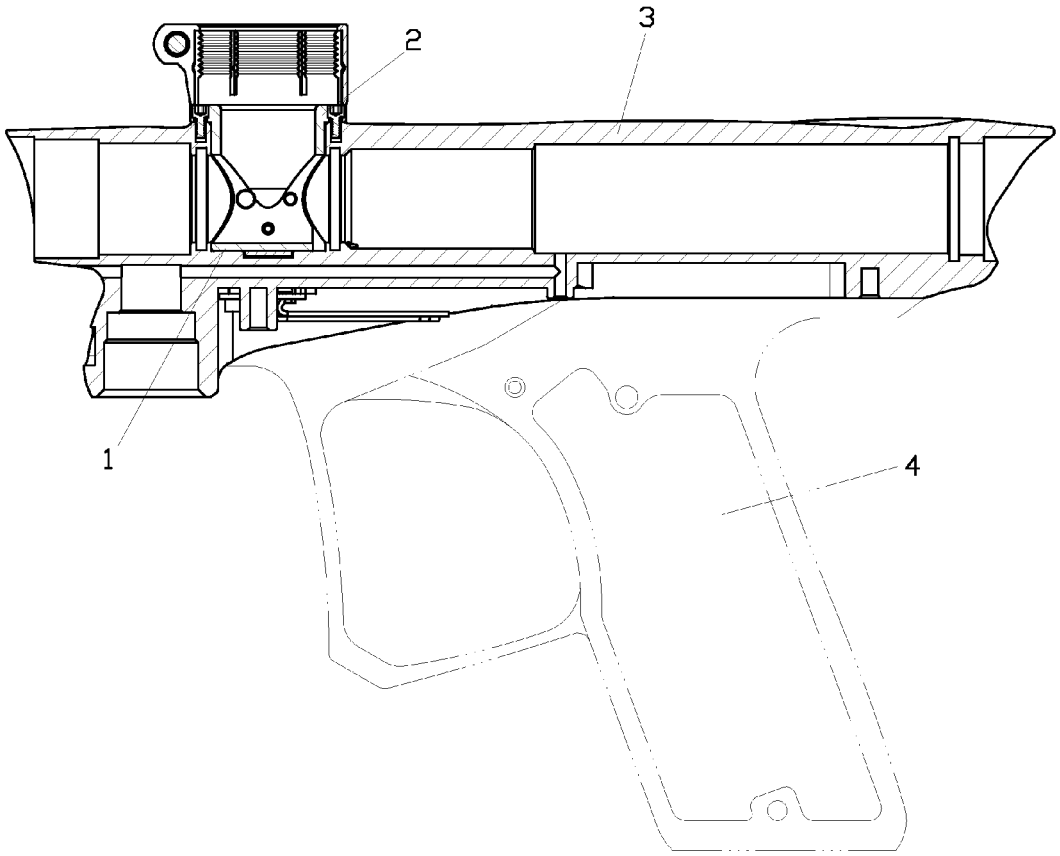
FIG. 4 schematically shows the present invention used in conjunction with a gun handle.
Figure 5:
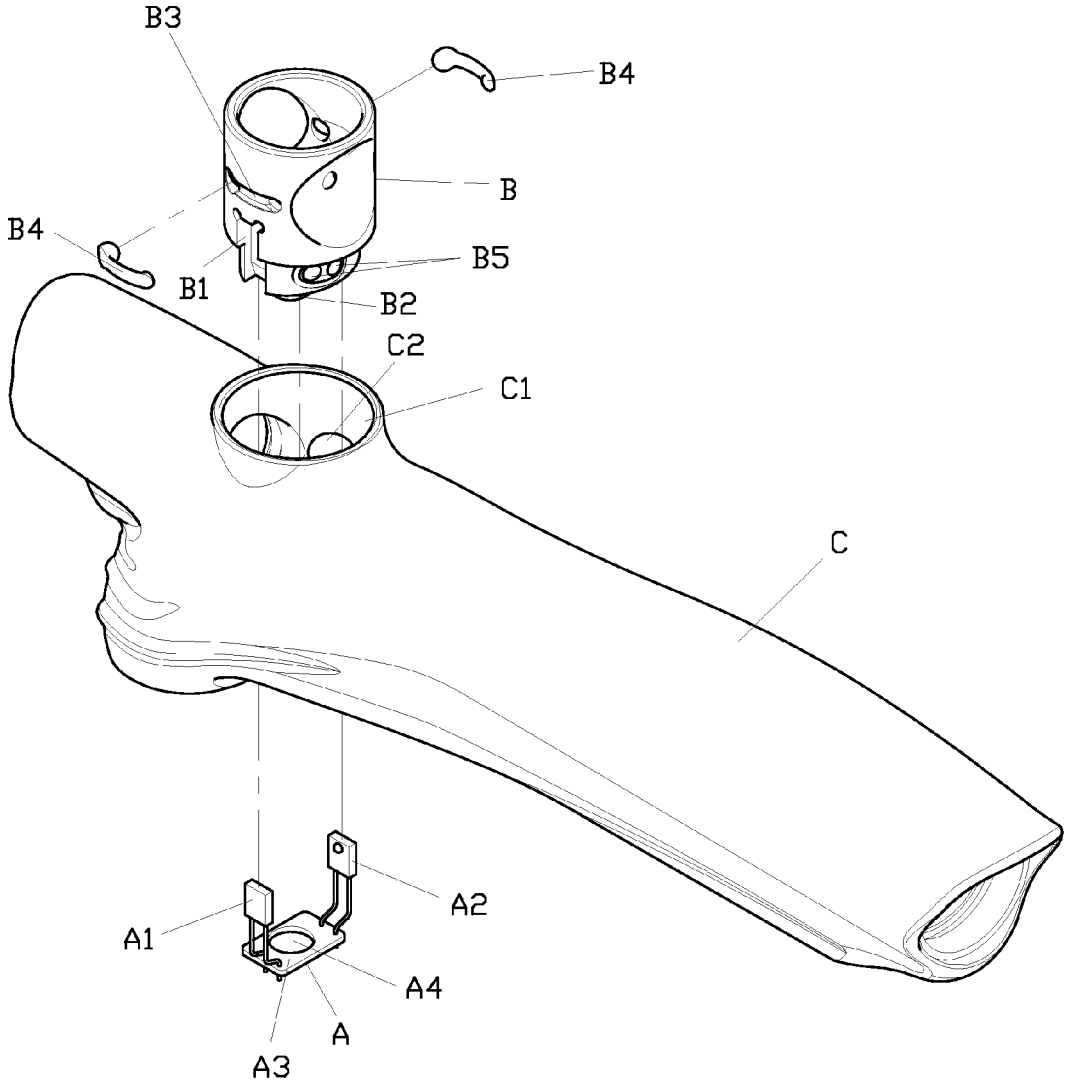
F I G. 5 Prior Art
FIG. 5 is an exploded perspective view of a prior art device.

Referring to FIG. 4, when the present invention is used along with a gun handle 4, the gun handle 4 is screwed to the gun body 3 by bolts threadingly fastened to the bottom end of the gun body 3 such that the gun handle 4 is located below the gun body 3.

What is claimed is:

1. A paintball sensor installing and positioning structure, comprising:

a sensor unit having a transmitting end and a receiving end which are bilaterally provided on the sensor unit and correspond in position to each other, the sensor unit further comprising a pin at a lower portion thereof;

a paintball dropping conduit having a top end centrally formed with a paintball dropping port and a bottom end to which the sensor unit is threadingly fastened, the paintball dropping conduit having an outer periphery whose bottom end is bilaterally provided with receiving grooves for receiving the transmitting end and the receiving end of the sensor unit, respectively, each said receiving groove having a through hole for enabling signal transmission between the transmitting end and the receiving end, the bottom end of the paintball dropping conduit being protrudingly provided with a positioning element; and a gun body having a top end formed with a receiving hole, the receiving hole configured for receiving the paintball dropping conduit inserted therein, the gun body concavely provided with a positioning recess corresponding in position to the positioning element of the paintball dropping conduit, the gun body having an inner wall provided with a gas inlet duct, the gas inlet duct being separate from the paintball dropping port, the gun body further having a bottom end to which a socket is threadingly fastened, the socket being in communication with the paintball dropping port and configured for connection with the pin of the sensor unit.

2. The paintball sensor installing and positioning structure as claimed in claim 1, wherein the outer periphery of the paintball dropping conduit is provided with arcuate slots above the receiving grooves.

3. The paintball sensor installing and positioning structure as claimed in claim 2, wherein each said arcuate slot is fitted with a resilient stopper.

4. The paintball sensor installing and positioning structure as claimed in claim 3, wherein each said stopper has an end whose inner surface is provided with a stud extending into the paintball dropping port of the paintball dropping conduit.

5. The paintball sensor installing and positioning structure as claimed in claim 1, wherein the top end of the paintball dropping conduit comprises a flange penetrated by a first threaded hole.

6. The paintball sensor installing and positioning structure as claimed in claim 1, wherein there is a second threaded hole beside the receiving hole of the gun body.

* * * * *